US010744395B2

(12) United States Patent
Gonzalez

(10) Patent No.: US 10,744,395 B2
(45) Date of Patent: Aug. 18, 2020

(54) VOLLEYBALL HITTING GLOVE

(71) Applicant: Joseph Gonzalez, Elyria, OH (US)

(72) Inventor: Joseph Gonzalez, Elyria, OH (US)

( * ) Notice: Subject to any disclaimer, the term of this patent is extended or adjusted under 35 U.S.C. 154(b) by 0 days.

(21) Appl. No.: 14/502,318

(22) Filed: Sep. 30, 2014

(65) Prior Publication Data

US 2015/0089713 A1 Apr. 2, 2015

Related U.S. Application Data

(60) Provisional application No. 61/884,533, filed on Sep. 30, 2013.

(51) Int. Cl.
*A63B 71/14* (2006.01)
*A63B 69/00* (2006.01)

(52) U.S. Cl.
CPC ..... *A63B 71/148* (2013.01); *A63B 69/0059* (2013.01); *A63B 2243/0095* (2013.01)

(58) Field of Classification Search
CPC ... A63B 71/141; A63B 71/143; A63B 71/145; A63B 71/148; A63B 71/14; A63B 69/0059; A63B 2243/0095; A63B 71/146; A63B 31/02; A41D 19/00; A41D 19/0006; A41D 19/0055; A41D 19/015; A41D 19/01523; A41D 19/01582; A41D 19/01588; A41D 19/0075
USPC ..... 2/161, 159, 161.1, 161.6, 163, 164, 167, 2/161.2, 19; 473/205
See application file for complete search history.

(56) References Cited

U.S. PATENT DOCUMENTS 835,588 A * 11/1906 Wells ..... A63B 31/04 2/159
1,284,178 A * 11/1918 Clarke ..... A63B 31/04 2/159
1,329,073 A * 1/1920 Czicziriga ..... A63B 31/04 2/159
1,631,735 A * 6/1927 Kennedy ..... A63B 71/143 2/169

(Continued)

FOREIGN PATENT DOCUMENTS

GB 2237726 A * 5/1991 ..... A41D 19/00

*Primary Examiner* — Anna K Kinsaul
*Assistant Examiner* — Abby M Spatz
(74) *Attorney, Agent, or Firm* — Eschweiler & Potashnik, LLC

(57) ABSTRACT

An athletic glove is provided, comprising a palm portion and a digit portion having a plurality of generally hollow digit sleeves extending from the palm portion. Each of the generally hollow digit sleeves is configured to generally confine a respective digit of a wearer. Spacers are provided between the generally hollow digit sleeves and generally maintain a predetermined abduction of the digits upon a relaxation of the wearer's hand, while generally permitting an adduction of the plurality of digits upon a predetermined adductive force exerted by the wearer. The spacers comprise a generally rigid member having a predetermined compressibility. The generally hollow digit sleeves may be closed or open at a distal end thereof. The palm portion may be a flexible fabric and a fitment apparatus selectively tightens the palm portion on a hand of the wearer. One or more padding portions may be further configured to distribute a force experienced by the wearer upon engagement with a ball.

11 Claims, 7 Drawing Sheets

(56) References Cited

U.S. PATENT DOCUMENTS 1,669,010 A * 5/1928 Natho ..... A63B 31/04 2/159
1,725,727 A * 8/1929 Armstrong ..... A63B 71/143 2/19
1,746,268 A * 2/1930 Lepetich ..... A63B 31/04 2/159
2,380,633 A * 7/1945 Daiber ..... A41D 19/01 2/158
2,995,757 A * 8/1961 Latina ..... A63B 71/143 2/19
3,398,951 A * 8/1968 Disko ..... A63B 71/148 2/161.6
4,058,863 A * 11/1977 Ferdico ..... A63B 31/04 441/57
4,071,913 A * 2/1978 Rector ..... A41D 19/01576 2/161.1
4,121,312 A * 10/1978 Penney ..... A63B 31/04 441/57
4,295,229 A * 10/1981 Clark ..... A63B 71/148 2/161.1
4,624,016 A * 11/1986 Luevano ..... A41D 19/01523 2/161.1
5,004,227 A * 4/1991 Hoffman ..... A63B 21/065 2/159
5,079,776 A * 1/1992 Crawford ..... A63B 71/141 2/162
5,113,530 A * 5/1992 Smith ..... A63B 71/143 2/19
5,316,294 A * 5/1994 Turangan ..... A63B 43/005 2/159
5,373,585 A * 12/1994 Wiggins ..... A41D 19/00 2/159
5,487,188 A * 1/1996 Micheloni ..... A61F 5/05866 2/159
5,608,912 A * 3/1997 Cumberland .... A41D 19/01582 2/16
5,641,316 A * 6/1997 Bakalis ..... A63B 31/04 441/57
5,678,245 A * 10/1997 Rector ..... A63B 71/143 2/19
5,697,103 A * 12/1997 Wiggins ..... A41D 19/00 2/159
5,809,569 A * 9/1998 Bruno ..... A41D 19/0034 2/158
5,820,526 A * 10/1998 Hoffman ..... A63B 21/065 441/57
5,974,587 A * 11/1999 Murai ..... A63B 71/143 2/161.1
6,108,817 A * 8/2000 Kostelac ..... A41D 19/0031 2/158
6,142,785 A * 11/2000 Williams ..... G09B 19/02 2/159
6,182,289 B1 * 2/2001 Brown ..... A63B 71/143 2/161.1
6,216,276 B1 * 4/2001 Eibert ..... A63B 71/146 2/161.2
6,279,165 B1 * 8/2001 Kobayashi ..... A41D 19/01529 2/16
6,536,046 B1 * 3/2003 Gilligan ..... A63B 71/143 2/161.1
6,832,391 B1 * 12/2004 Bower ..... A63B 71/141 2/159
7,278,170 B2 * 10/2007 Anderson ..... A63B 71/143 2/159
7,409,724 B2 * 8/2008 Murai ..... A63B 71/143 2/159
7,716,751 B2 * 5/2010 Cook ..... A41D 19/01529 2/160
7,954,174 B2 * 6/2011 Kume ..... A63B 71/143 2/158
8,001,620 B2 * 8/2011 Merkle ..... A41D 19/0027 2/159
8,458,817 B1 * 6/2013 Babb ..... A41D 19/0013 2/159
8,464,364 B2 * 6/2013 Hofeldt ..... A41D 19/01523 2/159
8,790,224 B1 * 7/2014 Davis ..... A63B 21/0084 441/50
2002/0184695 A1 * 12/2002 Fowler ..... A41D 13/087 2/159
2003/0033660 A1 * 2/2003 Sajovic ..... A41D 19/01547 2/161.1
2003/0154539 A1 * 8/2003 Lucas, Jr. ..... A41D 19/01582 2/161.1
2004/0068777 A1 * 4/2004 Wheelington, II .. A63B 71/143 2/161.1
2005/0114982 A1 * 6/2005 Gremmert ..... A41D 19/01517 2/159
2006/0212990 A1 * 9/2006 Mattesky ..... A41D 19/0006 2/161.6
2007/0150999 A1 * 7/2007 Brown ..... A41D 19/0048 2/159
2007/0226872 A1 * 10/2007 Huh ..... A41D 19/0017 2/159
2007/0245451 A1 * 10/2007 Desjardins ..... A41D 19/01523 2/159
2008/0109934 A1 * 5/2008 Widdemer ..... A63B 71/146 2/159
2008/0282445 A1 * 11/2008 Taliento ..... A41D 19/01523 2/161.3
2009/0183294 A1 * 7/2009 Lucas, Jr. ..... A41D 19/01523 2/161.1
2012/0042436 A1 * 2/2012 Jenkin ..... A41D 19/0013 2/158
2012/0131715 A1 * 5/2012 Copeland ..... A63B 71/143 2/16
2012/0204319 A1 * 8/2012 Gambordella ... A41D 19/01547 2/161.1
2012/0227155 A1 * 9/2012 Brown ..... A41D 19/01564 2/159
2013/0031696 A1 * 2/2013 Jundt ..... A41D 19/0082 2/161.7
2013/0219587 A1 * 8/2013 Clark ..... A41D 19/0051 2/161.1
2013/0283497 A1 * 10/2013 Tamaribuchi .... A41D 19/01547 2/159

* cited by examiner

VOLLEYBALL HITTING GLOVE

REFERENCE TO RELATED APPLICATION

This application claims priority to and the benefit of U.S. Provisional Application Ser. No. 61/884,533 which was filed Sep. 30, 2013, entitled "VOLLEYBALL HITTING GLOVE", the entirety of which is hereby incorporated by reference as if fully set forth herein.

FIELD

The present disclosure relates sporting gloves, and more specifically to an athletic glove having splayed fingers for inducing and maintaining an increased contact area with a volleyball.

BACKGROUND

Athletic gloves are commonly used in a variety of sports. Typical athletic gloves are designed to provide padding or cushioning to a player's fingers while providing a maximum amount of flexibility for a player's fingers. For instance, some athletic gloves have been configured to limit a maximum extension (e.g., straightening the joint resulting in an increase of angle, or moving the base of the fingers away from the palm of the hand) and a maximum abduction (e.g., a lateral movement away from the axial line, or movement of the fingers away from the middle finger) of the player's fingers in order to prevent injury of the player's hand. Some conventional gloves provide padding for the player's fingers and palms in order to further limit strain or injury when the hand experiences a contact force with a sporting object, such as a ball.

Such conventional gloves are commonly designed to provide maximum flexibility and versatility in the movement of the player's fingers, where injury is a primary concern for limiting any movement. Accordingly, conventional gloves have not been designed to limit adduction, (e.g., movement of the fingers toward the axial line, or movement of the fingers toward the middle finger), as adduction injuries are typically not a concern and are not a commonplace sporting injury. Rather, adduction of the fingers toward one another is conventionally desirable in athletic gloves, whereby hyperextension may be averted for various sports.

SUMMARY

The present disclosure overcomes the limitations of the prior art by providing an athletic glove having at least one separating member that provides a predetermined abduction and adduction of two or more fingers when the two or more fingers are in a relaxed state. Accordingly, the following presents a simplified summary of the disclosure in order to provide a basic understanding of some aspects of the disclosure. This summary is not an extensive overview of the disclosure. It is intended to neither identify key or critical elements of the invention nor delineate the scope of the invention. Its purpose is to present some concepts of the invention in a simplified form as a prelude to the more detailed description that is presented later.

In accordance with the present disclosure an athletic glove is provided, such as a glove for use in playing volleyball or other sports. The athletic glove of the present disclosure comprises a palm portion and a digit portion, wherein the digit portion has a plurality of generally hollow digit sleeves extending from the palm portion. Each of the generally hollow digit sleeves, for example, is configured to generally confine a respective digit of a wearer's hand. The plurality of generally hollow digit sleeves may be closed at a distal end thereof, or may comprise a plurality of open cylinders extending to approximately the intermediate phalanges of the wearer.

According to one example, one or more spacers are respectively provided between one or more pairs of the plurality of generally hollow digit sleeves. The one or more spacers, for example, generally maintain a predetermined spacing between the respective one or more pairs of the plurality of generally hollow digit sleeves, therein providing a predetermined abduction of the respective digits of the wearer and generally preventing a predetermined adduction of the plurality of the respective digits of the wearer. The one or more spacers, for example, are configured to generally maintain the predetermined spacing between the respective one or more pairs of the plurality of generally hollow digit sleeves up to a predetermined adductive force. In another example, the one or more spacers generally maintain the predetermined abduction of the plurality of digits concurrent with a relaxation of the wearer's hand, and generally permit an adduction of the plurality of digits upon exertion of the predetermined adductive force by the wearer.

The one or more spacers may comprise a generally rigid member and may be comprised of a plastic, foam, gel, rubber, or metal. In another example, the one or more spacers are comprised of a solid or semi-solid material having a predetermined compressibility, such as neoprene. A bulk modulus of the one or more spacers according to one example may be on the order of 10 MPa or greater.

A webbing, for example, may further connect the respective one or more pairs of the generally hollow digit sleeves. Two of the more of the generally hollow digit sleeves may be closely coupled to one another, such as the generally hollow digit sleeves associated with a ring finger and a pinky finger. In one example, such generally hollow digit sleeves may be directly stitched to one another or otherwise fixedly coupled to one another.

The plurality of generally hollow digit sleeves, for example, may comprise two or more of a thumb sleeve, an index finger sleeve, a middle finger sleeve, a ring finger sleeve, and a pinky finger sleeve. In one example, a generally hollow digit sleeve is provided for each of the thumb, index finger, middle finger, ring finger, and pinky finger of the wearer. One or more spacers, for example, are provided between respective pairs of the plurality of generally hollow digit sleeves.

The palm portion may comprise one or more of a flexible fabric, a synthetic material, and leather, and may further comprise a fitment apparatus configured to selectively tighten the palm portion onto a hand of the wearer. The fitment apparatus, for example, may comprise one or more of a hook and loop fastener, an elastic band, and a buckle fastener. One or more padding portions can be associated with one or more of the palm portion and digit portion, wherein the one or more padding portions are configured to distribute a force experienced by the wearer upon engagement with a ball or other surface, such as a playing court. One or more of an indicia and a logo may be further positioned, attached, or otherwise provided on one or more of the palm a portion and digit portion.

Further, the palm portion may entirely cover the palm of the wearer. Alternatively, the palm portion can partially cover the palm of the wearer, leaving a portion of the wearer's palm exposed for better ball feel.

The above summary is merely intended to give a brief overview of some features of some embodiments of the present invention, and other embodiments may comprise additional and/or different features than the ones mentioned above. In particular, this summary is not to be construed to be limiting the scope of the present application. Thus, to the accomplishment of the foregoing and related ends, the invention comprises the features hereinafter described and particularly pointed out in the claims. The following description and the annexed drawings set forth in detail certain illustrative embodiments of the invention. These embodiments are indicative, however, of a few of the various ways in which the principles of the invention may be employed. Other objects, advantages and novel features of the invention will become apparent from the following detailed description of the invention when considered in conjunction with the drawings.

DETAILED DESCRIPTION

Figure 1A:
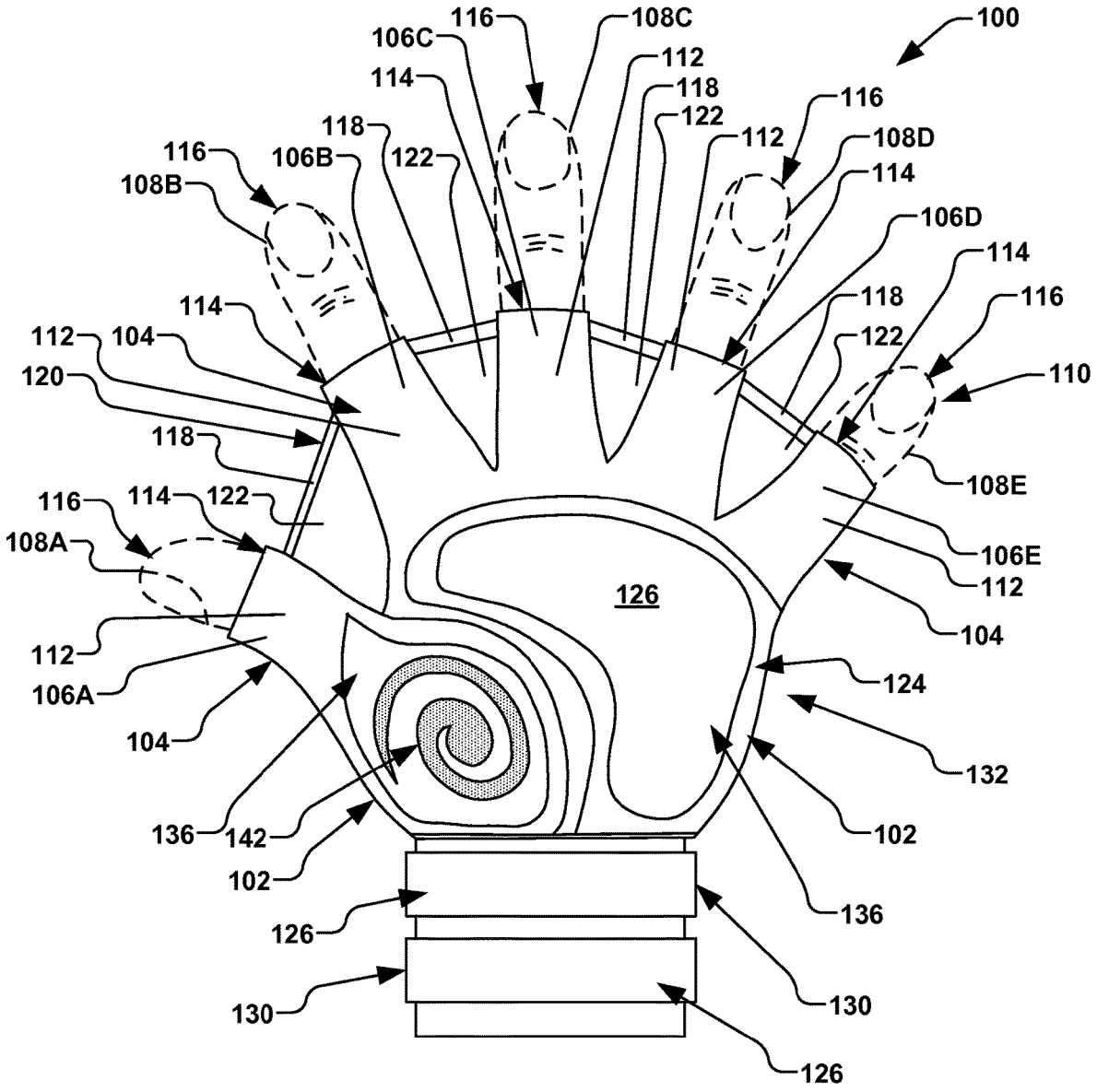
FIG. 1A illustrates a top plan view of an exemplary athletic glove in accordance with several aspects of the disclosure.

The present disclosure is directed generally toward an athletic glove having a separating member that provides a predetermined abduction and adduction of the fingers of a wearer. Accordingly, the present invention will now be described with reference to the drawings, wherein like reference numerals may be used to refer to like elements throughout. It is to be understood that the description of these aspects are merely illustrative and that they should not be interpreted in a limiting sense. In the following description, for purposes of explanation, numerous specific details are set forth in order to provide a thorough understanding of the present disclosure. It will be evident to one skilled in the art, however, that the present invention may be practiced without these specific details. Further, the scope of the invention is not intended to be limited by the embodiments or examples described hereinafter with reference to the accompanying drawings, but is intended to be only limited by the appended claims and equivalents thereof.

It is also noted that the drawings are provided to give an illustration of some aspects of embodiments of the present disclosure and therefore are to be regarded as schematic only. In particular, the elements shown in the drawings are not necessarily to scale with each other, and the placement of various elements in the drawings is chosen to provide a clear understanding of the respective embodiment and is not to be construed as necessarily being a representation of the actual relative locations of the various components in implementations according to an embodiment of the invention. Furthermore, the features of the various embodiments and examples described herein may be combined with each other unless specifically noted otherwise.

Figure 1B:
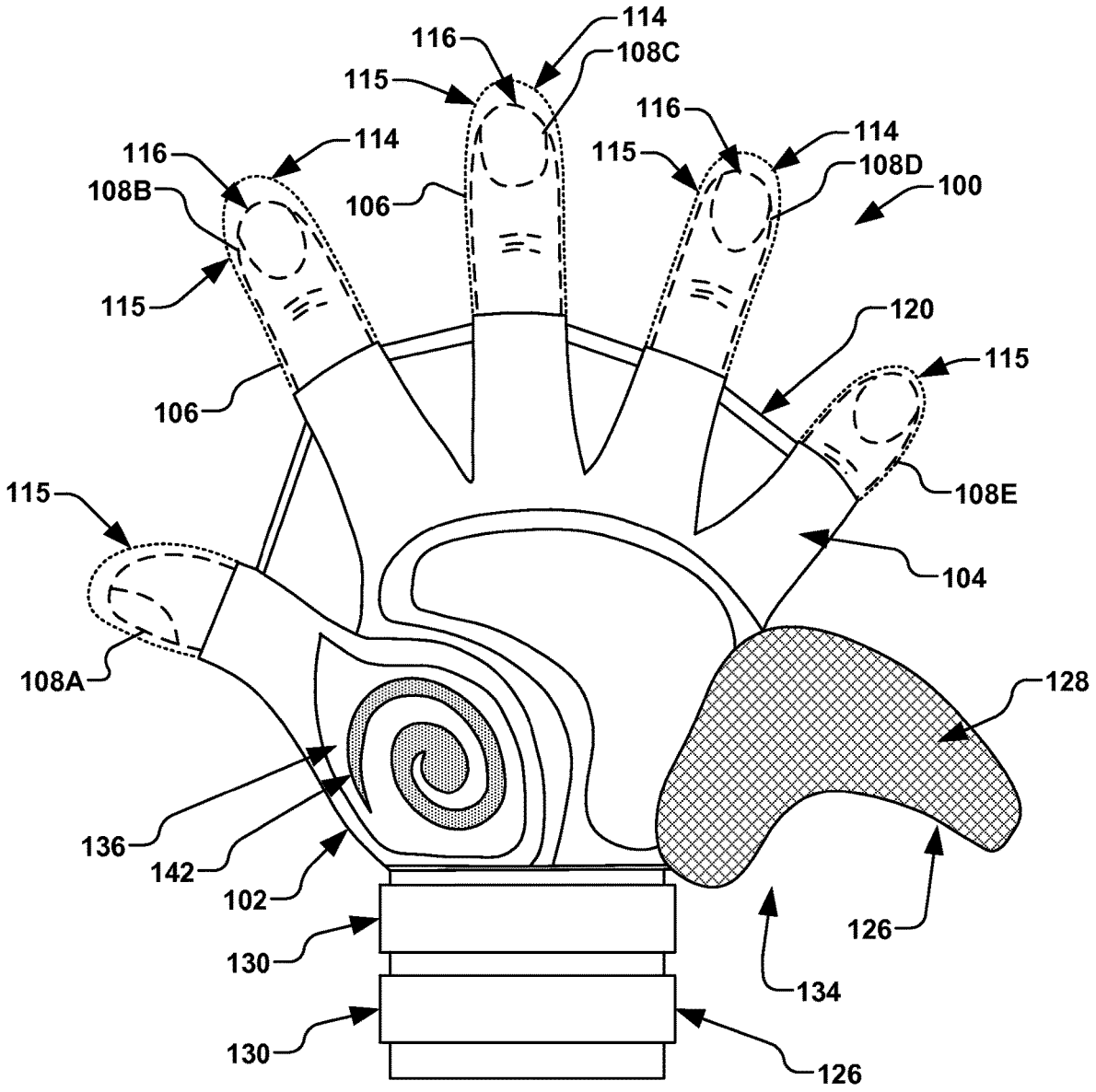
FIG. 1B illustrates another top plan view of the exemplary athletic glove of FIG. 1A with a fitment apparatus in an opened position in accordance with another aspect of the disclosure.
Figure 1C:
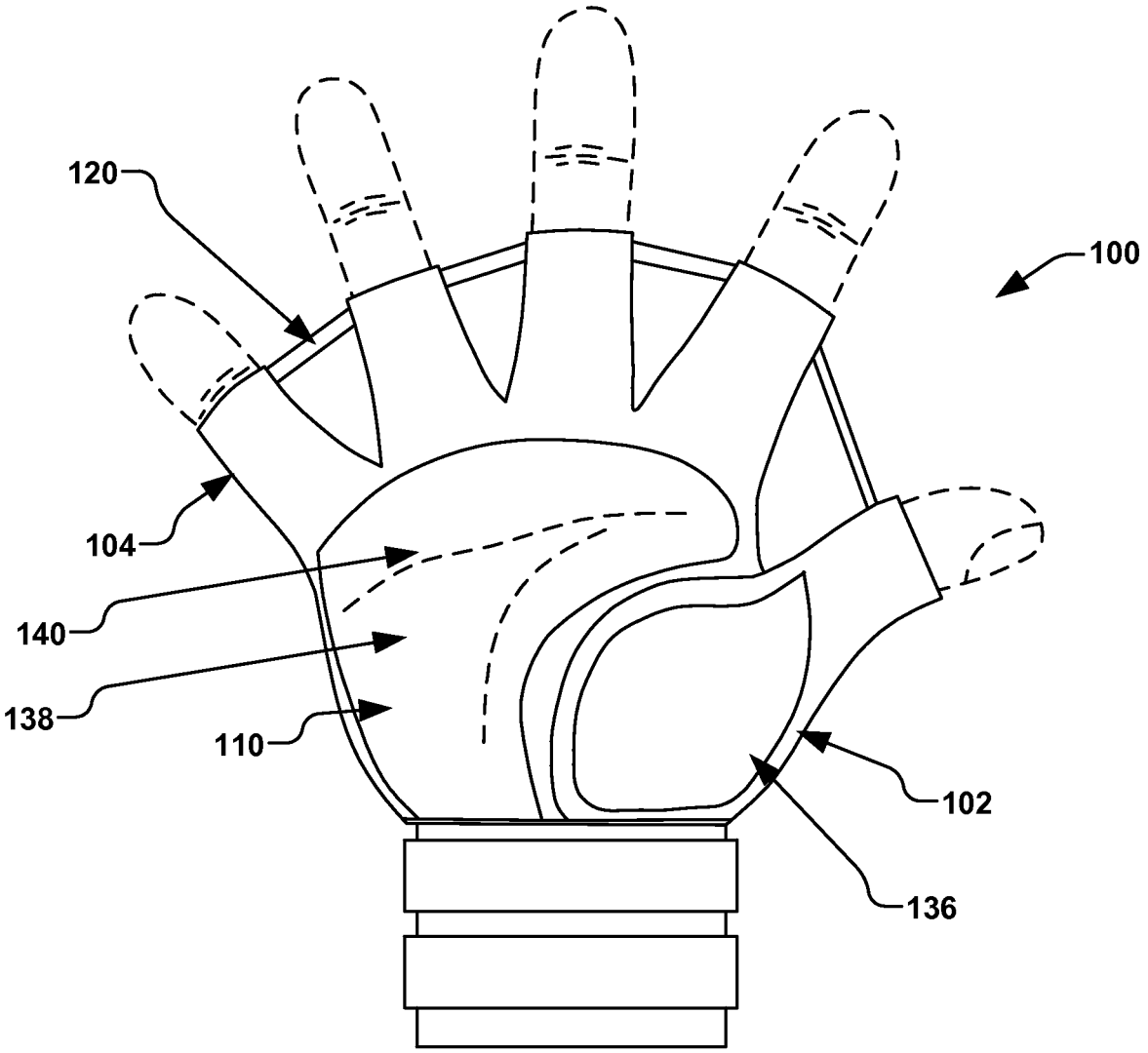
FIG. 1C illustrates a bottom plan view of the exemplary athletic glove of FIGS. 1A-1B in accordance with various aspects of the disclosure.
Figure 2A:
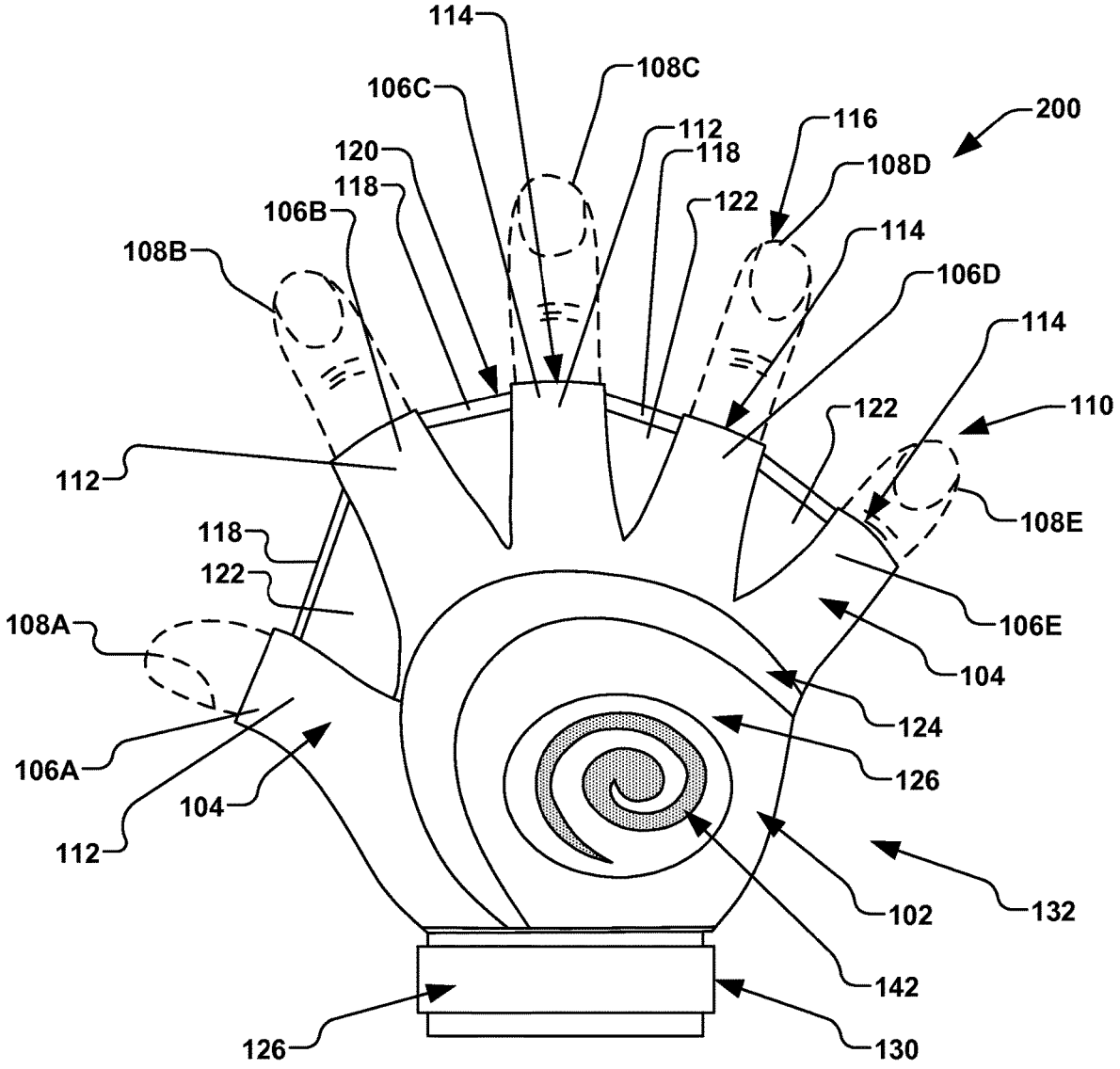
FIG. 2A illustrates a top plan view of another exemplary athletic glove in accordance with various aspects of the disclosure.
Figure 2B:
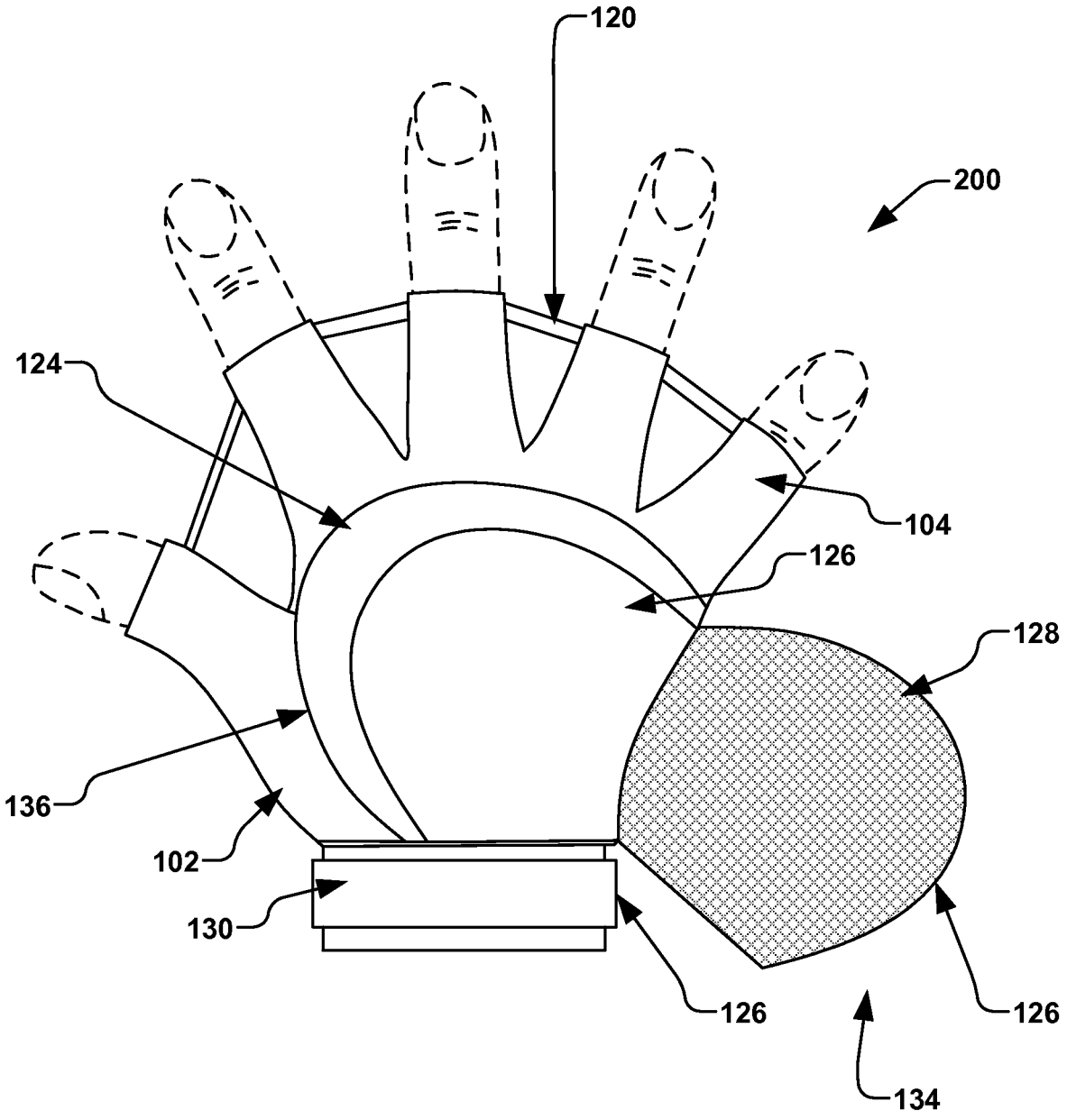
FIG. 2B illustrates another top plan view of the exemplary athletic glove of FIG. 2A with a fitment apparatus in an opened position in accordance with another aspect of the disclosure.
Figure 2C:
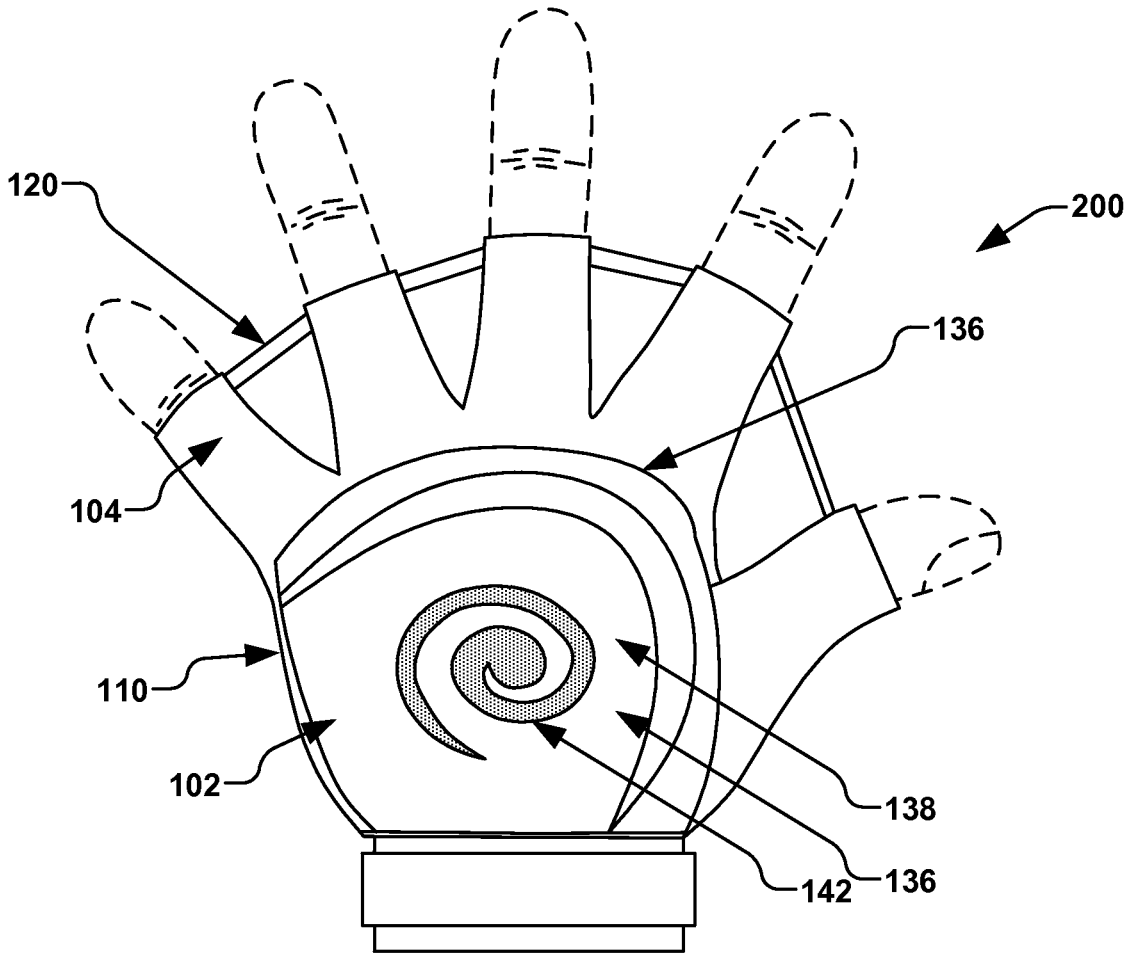
FIG. 2C illustrates a bottom plan view of the exemplary athletic glove of FIGS. 2A-2B in accordance with various aspects of the disclosure.

In accordance with one aspect of the disclosure, an exemplary athletic glove 100 is illustrated generally in FIGS. 1A-1C, and another exemplary athletic glove 200 is illustrated in FIGS. 2A-2C, wherein like reference numerals are provided to refer to like elements. The athletic glove 100, 200 of the present disclosure may be advantageously used as a training aid during non-match play or practice. The athletic glove 100, 200 may likewise be used during game or match play. In accordance with the present disclosure, the athletic glove 100, 200 is preferably for use in playing volleyball, however the use of the athletic glove for other sports or other applications are also contemplated. The athletic glove 100, as illustrated in FIG. 1A, for example, comprises a palm portion 102 and a digit portion 104.

The digit portion 104, for example, has a plurality of generally hollow digit sleeves 106 generally extending from the palm portion 102, wherein each of the generally hollow digit sleeves is configured to generally confine a respective finger or digit 108 of a wearer's hand 110. The plurality of generally hollow digit sleeves 106, for example, comprise two or more of a thumb sleeve 106A, an index finger sleeve 106B, a middle finger sleeve 106C, a ring finger sleeve 106D, and a pinky finger sleeve 106E associated with a respective thumb 108A, index finger 108B, middle finger 108C, ring finger 108D, and pinky finger 108E of the wearer's hand 110.

The plurality of generally hollow digit sleeves 106, for example, comprise a plurality of open-ended cylinders 112, wherein a wearer's digits 108 may extend through a distal end 114 of the generally hollow digit sleeves. Alternatively, one or more of the generally hollow digit sleeves 106 may be closed at the distal end 114 thereof, as illustrated by phantom line 115 in FIG. 1B, wherein the distal end is associated with the ends 116 of the digits 108, therein generally enclosing the digits within the generally hollow digit sleeves.

According to another aspect, one or more spacers 118 are respectively provided between one or more pairs of the plurality of generally hollow digit sleeves (e.g., 106A and 106B, 106B and 106C, 106C and 106D, 106D and 106E). The one or more spacers 118, for example, generally maintain a predetermined spacing between the respective one or more pairs of the plurality of generally hollow digit sleeves 106, therein providing a predetermined abduction (e.g., a lateral movement away from the axial line of neighboring digits 108, or movement of the digits away from the middle finger 108C) of the respective digits of the wearer and generally preventing a predetermined adduction of the respective digits of the wearer. The plurality of spacers 118, for example, may further generally maintain the predetermined abduction of the plurality of digits 108 upon a relaxation of the wearer's hand 110, wherein the plurality of spacers further generally permit an adduction (e.g., movement of the digits toward the axial line, or movement of the fingers toward the middle finger 108C) of the plurality of digits 108 upon a predetermined adductive force exerted by the wearer.

Accordingly, the one or more spacers 118 are configured to generally maintain the predetermined spacing between the respective one or more pairs of the plurality of generally hollow digit sleeves 106 up to a predetermined adductive force being exerted by the digits 108. Thus, the one or more spacers 118, for example, generally maintain the predetermined abduction of the plurality of digits 108 concurrent with a relaxation of the wearer's hand 110, and the one or more spacers generally permit an adduction of the plurality of digits upon exertion of the predetermined adductive force by the wearer.

The one or more spacers 118, for example, may comprise a generally rigid member 120 comprised of a rubber, plastic or metal. In another example, the one or more spacers 118 may be comprised of a gel, foam material or semi-solid material having a predetermined compressibility, such as neoprene. The one or more of spacers 118, for example, may have a bulk modulus of 10 MPa or greater. The one or more of spacers 118 may further connect the generally hollow digit sleeves 106 with a webbing 122. The webbing 122, for example, may further limit abduction of the digits 108, thus further preventing injury.

Figure 1D:
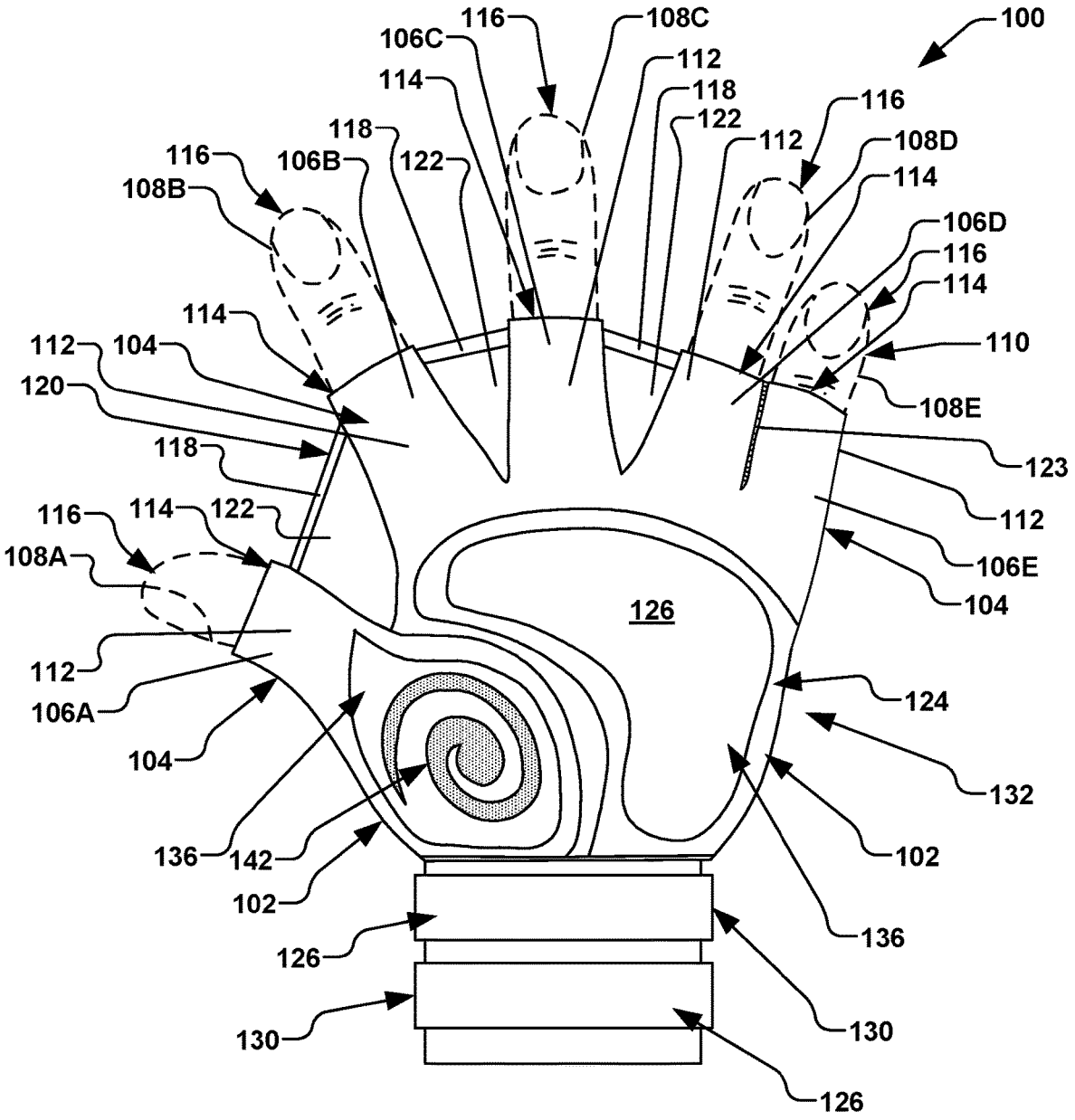
FIG. 1D illustrates another top plan view of the exemplary athletic glove of FIG. 1A having a ring finger sleeve and pinky finger sleeve closely coupled to one another in accordance with another aspect of the disclosure.

In accordance with another example, two of the more of the generally hollow digit sleeves 106 may be closely coupled to one another, such as by stitching or otherwise coupling the generally hollow digit sleeves to one another. For example, the generally hollow digit sleeves 106D, 106E associated with the respective ring finger 108D and pinky finger 108E illustrated in FIG. 1D may be stitched or otherwise closely coupled to one another. As such, the spacer 118 between the ring finger 108D and pinky finger 108E of FIG. 1A, for example, is absent and is replaced with stitching 123 of FIG. 1D that closely (e.g., directly) couples the generally hollow digit sleeves 106D, 106E of the ring finger and pinky finger. Thus, the stitching generally forces the ring finger 108D and pinky finger 108E to move in unison. Accordingly, extra support to the pinky finger 108E is provided by the ring finger 108D, thus generally preventing dislocation injuries, those often experienced with blocking moves during volleyball play.

In another example, the palm portion 102 may be comprised of one or more of a flexible fabric, a synthetic material, and leather. The palm portion 102, for example, may comprise a flexible fabric shell 124 that may be form-fitted to the wearer's hand 110. It should be noted that one or more of the palm portion 102 and digit portion 104 of the athletic glove 100 may be comprised of one or more of leather, fabric, or other synthetic or natural materials.

According to another aspect, the palm portion 102 may further comprise a fitment apparatus 126 configured to selectively tighten the palm portion 102 onto the hand 110 of the wearer or otherwise provide support for the wearer's hand. The fitment apparatus 126, for example, may comprise one or more of a hook and loop fastener 128, and an elastic band 130 (e.g., shown in a fastened position 132 in FIGS. 1A and 2A). Alternatively, a buckle fastener or other fastener (not shown) may be provided. As illustrated in FIGS. 1B and 2B, the fitment apparatus 126 comprises hook and loop fastener 128 in an unfastened position 134, whereby the wearer may more easily insert their hand 110 into the athletic glove 100, 200.

In another example, one or more padding portions 136 may be provided and associated with one or more of the palm portion 102 and digit portion 104, as illustrated in FIGS. 1A-1C and 2A-2C. The one or more padding portions 136, for example, are configured to absorb and/or distribute a force experienced by the wearer upon engagement of the hand 110 with a ball or other object (not shown). For example, during serving or blocking in the sport of volleyball, the one or more padding portions 136 generally prevent repetitive strain and/or injury to the hand 110.

The one or more padded portions 136, for example, may comprise one or more of gel, material padding, leather, or other materials configured to absorb or distribute forces associated with the sport being played. As illustrated in FIG. 1C, the palm portion 102 may partially cover the palm 138 of the wearer, leaving a portion 140 of the wearer's palm exposed for better ball feel. Alternatively, the palm portion 102 may fully cover the palm 138 of the wearer, as illustrated in FIG. 2C.

In another example, one or more of an indicias and/or logos may be placed or otherwise positioned on the athletic glove 100, 200. For example, an indicia or logo 142 may be incorporated into the one or more padded portions 136, and may be placed on one or more of the palm portion 102 and digit portion 104 of the athletic glove 100, 200 for advertising, branding, fashion, etc.

Accordingly, the present disclosure provides an athletic glove 100, 200 that may be used as a training aid, while also permitting use during match play. The athletic glove 100, 200 may aid in keeping fingers in an outstretched position in order to better field balls, and muscle memory can be learned by practice utilizing the athletic glove of the present disclosure. As such, better control of the ball may be achieved with less instruction by a coach in order to maintain fingers in the outstretched position.

Although the disclosure has been shown and described with respect to a certain embodiment or embodiments, it should be noted that the above-described embodiments serve only as examples for implementations of some embodiments of the present disclosure, and the application of the present disclosure is not restricted to these embodiments. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the disclosure. In addition, while a particular feature of the disclosure may have been disclosed with respect to only one of several embodiments, such feature may be combined with one or more other features of the other embodiments as may be desired and advantageous for any given or particular application. Accordingly, the present disclosure is not to be limited to the above-described embodiments, but is intended to be limited only by the appended claims and equivalents thereof.

The invention claimed is:

1. An athletic glove, comprising:

a palm portion comprised of one or more of a flexible fabric, a synthetic material, and leather;

a fitment apparatus associated with the palm portion, wherein the fitment apparatus is configured to selectively tighten the palm portion onto a hand of a wearer and comprises one or more of a hook and loop fastener, an elastic band, and a buckle fastener;

a digit portion having a plurality of hollow digit sleeves extending from the palm portion, wherein each hollow digit sleeve of the plurality of hollow digit sleeves is configured to confine a respective digit of the hand, wherein the plurality of hollow digit sleeves comprise a thumb sleeve, an index finger sleeve, a middle finger sleeve, a ring finger sleeve, and a pinky finger sleeve, and wherein respective lengths of the ring finger sleeve and the pinky finger sleeve are closely coupled to one another via stitching, wherein the stitching generally forces the ring finger sleeve and the pinky finger sleeve to move in unison; and a plurality of spacers, wherein a respective one of each of the plurality of spacers is provided between each of the thumb sleeve and the index finger sleeve, the index finger sleeve and the middle finger sleeve, and the middle finger sleeve and the ring finger sleeve, wherein the plurality of spacers are configured to maintain a respective predetermined spacing between the thumb sleeve and the index finger sleeve, the index finger sleeve and the middle finger sleeve, and the middle finger sleeve and the ring finger sleeve up to a predetermined adductive force applied between each of the respective thumb sleeve and the index finger sleeve, the index finger sleeve and the middle finger sleeve, and the middle finger sleeve and the ring finger sleeve, wherein no spacer is provided between the ring finger sleeve and the pinky finger sleeve, and wherein the plurality of spacers maintain a predetermined abduction of the thumb sleeve and the index finger sleeve, the index finger sleeve and the middle finger sleeve, and the middle finger sleeve and the ring finger sleeve, respectively, in a relaxed state.

2. The athletic glove of claim 1, wherein one or more of the plurality of spacers comprise a generally rigid member.

3. The athletic glove of claim 1, wherein the one or more of the plurality of spacers are comprised of a plastic, rubber, or metal.

4. The athletic glove of claim 1, wherein the one or more of the plurality of spacers are comprised of a foam material having a predetermined compressibility.

5. The athletic glove of claim 4, wherein one or more of the plurality of spacers have a bulk modulus of 10 MPa or greater.

6. The athletic glove of claim 4, wherein the foam material comprises neoprene.

7. The athletic glove of claim 1, wherein the plurality of hollow digit sleeves are closed at a distal end thereof.

8. The athletic glove of claim 1, wherein the plurality of hollow digit sleeves comprise a plurality of open-ended cylinders.

9. The athletic glove of claim 1, further comprising one or more padding portions associated with one or more of the palm portion and digit portion, wherein the one or more padding portions are configured to distribute a force exerted thereto upon engagement with a ball.

10. The athletic glove of claim 1, further comprising one or more of an indicia and a logo positioned on one or more of the palm portion and digit portion.

11. The athletic glove of claim 1, further comprising a webbing, wherein the webbing connects one or more pairs of the plurality of hollow digit sleeves.

* * * * *